US005964110A

United States Patent [19]

Crocco et al.

[11] Patent Number: 5,964,110

[45] Date of Patent: Oct. 12, 1999

[54] KEY LOCK WITH REMOVABLE PLUG

[75] Inventors: John J. Crocco, Gurnee; John J. Velinski, Chicago, both of Ill.

[73] Assignee: The Eastern Company, Wheeling, Ill.

[21] Appl. No.: 08/968,178

[22] Filed: Nov. 12, 1997

Related U.S. Application Data

[63] Continuation of application No. 08/712,291, Sep. 11, 1996, abandoned.

[51] Int. Cl.[6] ..... E05B 29/02

[52] U.S. Cl. ..... 70/369; 70/421; 70/337

[58] Field of Search ..... 70/337, 369, 370, 70/371, 421, 339

[56] References Cited

U.S. PATENT DOCUMENTS

| | | | |
|---|---|---|---|
| 1,805,891 | 5/1931 | Shinn | 70/369 |
| 1,990,934 | 2/1935 | Falk | 70/369 |
| 2,000,829 | 5/1935 | Falk . | |
| 2,009,640 | 7/1935 | Stone et al. | 70/337 |
| 2,036,764 | 4/1936 | Lowe . | |
| 2,061,456 | 11/1936 | Falk | 70/369 |
| 3,399,555 | 9/1968 | Gray et al. . | |
| 3,667,264 | 6/1972 | Surko, Jr. et al. . | |
| 3,713,311 | 1/1973 | Oliver et al. . | |
| 3,785,182 | 1/1974 | Van Lahr . | |
| 4,009,599 | 3/1977 | Patriquin | 70/371 |
| 4,123,926 | 11/1978 | Elder . | |
| 4,191,037 | 3/1980 | Patriquin . | |
| 4,272,975 | 6/1981 | Patriquin . | |
| 4,328,690 | 5/1982 | Oliver . | |
| 4,398,405 | 8/1983 | Patriquin . | |
| 4,484,462 | 11/1984 | Berkowitz . | |
| 4,539,828 | 9/1985 | Teleky . | |
| 4,630,452 | 12/1986 | Kincaid et al. . | |
| 4,712,400 | 12/1987 | Steinbach . | |
| 4,761,978 | 8/1988 | Walla . | |
| 4,976,123 | 12/1990 | Ceron et al. | 70/371 |
| 5,101,649 | 4/1992 | Duval | 70/369 |
| 5,109,685 | 5/1992 | Westwinkel | 70/369 |
| 5,119,654 | 6/1992 | Ceron et al. | 70/421 |
| 5,182,929 | 2/1993 | Myers | 70/337 |

*Primary Examiner*—Darnell M. Boucher
*Attorney, Agent, or Firm*—Wood, Phillips, VanSanten, Clark & Mortimer

[57] ABSTRACT

A lock with a keyed removable plug having a substantially cylindrical body, and a plurality of tumblers disposed within the body and movable between a first position retracted within the cylindrical body of the plug and a second position with one end extending from the body. A retaining tab extends radially from the plug body at an angle from the radial orientation of the tumblers. A shell has a substantially cylindrical opening therein for removably receiving the plug in a first shell end. The shell further includes an annular shoulder spaced from the first shell end and engageable by the plug retaining tab and a retaining one of the tumblers when in its second position. Tumbler grooves extend axially along the sides of the shell opening from the first shell end to a groove end short of the shoulder, and a release groove extends axially along the shell opening from the first shell end to the shoulder to define an opening in the shoulder. Engagement of either the retaining tab or the retaining tumbler with the annular shoulder retains the plug in the shell. An operating key engages the tumblers to orient all but the retaining tumbler in the first position to permit pivoting of the plug within the shell with at least one of the retaining tab and the retaining tumbler aligned with the shell shoulder to retain the plug in the shell. A removing key engages the tumblers to orient all of the tumblers in the first position to permit pivoting of the plug within the shell to a removal position in which the retaining tab is aligned with the release groove.

26 Claims, 1 Drawing Sheet

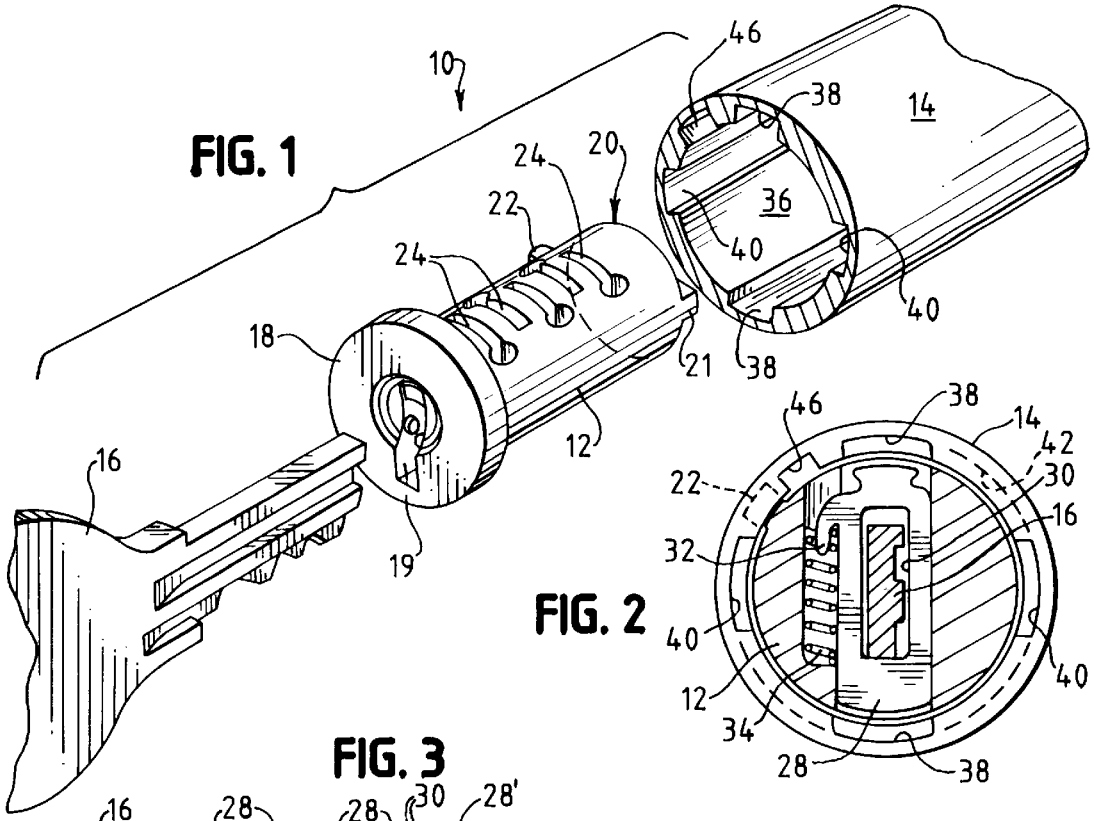
FIG. 1
FIG. 2
FIG. 3
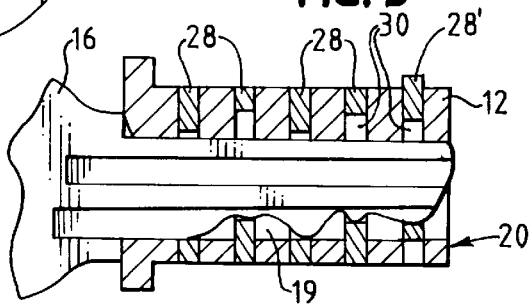
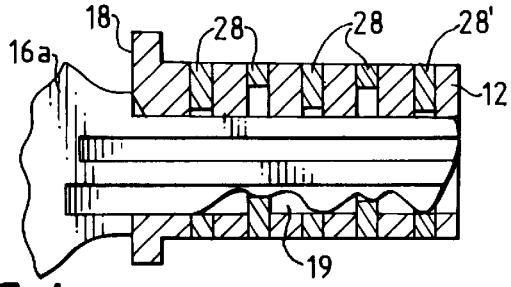
FIG. 4
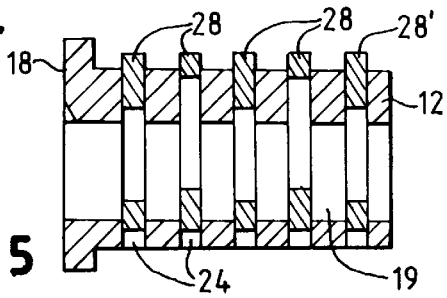
FIG. 5
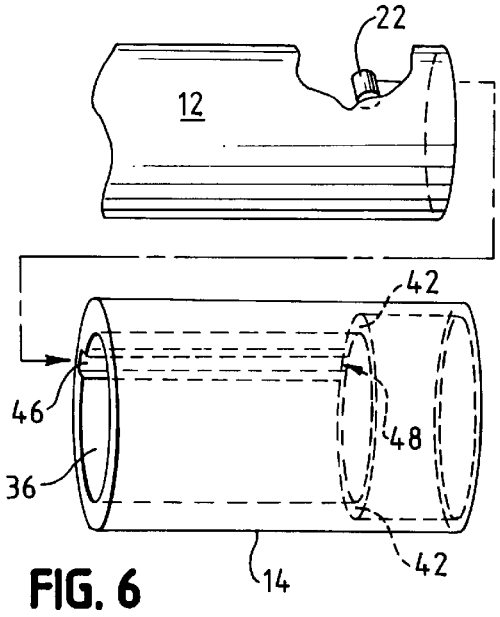
FIG. 6

KEY LOCK WITH REMOVABLE PLUG

This application is a continuation of application Ser. No. 08/712,291, filed Sep. 11, 1996, abandoned.

BACKGROUND OF THE INVENTION

1. Technical Field

The present invention is directed toward a key lock, and more particularly toward a key lock having a removable plug.

2. Background Art

Key locks with removable plugs are old in the art, and generally involve a shell mounted to the object to be locked, a plug insertable into and removable from the shell; and two keys, one of which allows the plug to be removed from the shell.

U.S. Pat. No. 4,398,405 discloses a key controlled lock with removable plug in which a retaining end of a control tumbler prevents withdrawal of the plug by extending into a circumferential groove within the barrel. The plug becomes removable when a separate key retracts the control tumbler into the plug, and extends another end of the control tumbler from the plug into an aligned longitudinal groove to allow removal of the plug. Only the biased retaining end of a control tumbler holds the plug within the barrel. Because tumblers are generally made of a lightweight material not designed to withstand the longitudinal forces of one pulling a plug out of the shell while the retaining end of the control tumbler extends into the retaining groove, the thin retaining end of the tumbler does not necessarily provide the strength required to prevent a person from breaking off or bending the control tumbler when attempting to forcibly remove such a plug.

Another structure is shown in U.S. Pat. No. 4,630,457. However, while this structure allows the use of a relatively stronger flange on the plug near the key face to retain the plug in the shell, this structure prevents a full 360° rotation of the plug within the barrel and therefore prevents it from being used in some environments which require such a full range of operation.

The present invention is directed toward overcoming one or more of the problems set forth above.

SUMMARY OF THE INVENTION

In one aspect of the present invention, a lock is provided with a keyed removable plug having a substantially cylindrical body, and a plurality of tumblers disposed within the body and movable between a first position retracted within the cylindrical body of the plug and a second position with one end extending from the body. A retaining tab extends radially from the plug body at an angle from the radial orientation of the tumblers. A shell has a substantially cylindrical opening therein for removably receiving the plug in a first shell end. The shell further includes an annular shoulder spaced from the first shell end and engageable by the plug retaining tab and a retaining one of the tumblers when in its second position, tumbler grooves extending axially along the sides of the shell opening from the first shell end to a groove end short of the shoulder, and a release groove extending axially along the shell opening from the first shell end to the shoulder to define an opening in the shoulder. Engagement of either the retaining tab or the retaining tumbler with the annular shoulder retains the plug in the shell.

In another aspect of the present invention, a key set is provided including an operating key and a removing key, wherein the operating key engages the tumblers to orient all but the retaining tumbler in the first position, and the removing key engages the tumblers to orient all of the tumblers in the first position.

In a preferred form of this aspect of the present invention, the operating key retracts all but the retaining tumbler within the plug cylindrical body to permit pivoting of the plug within the shell with at least one of the retaining tab and the retaining tumbler aligned with the shell shoulder to retain the plug in the shell. In another preferred form of this aspect of the present invention, the removing key retracts all of the tumblers within the plug cylindrical body to permit pivoting of the plug within the shell to a removal position in which the retaining tab is aligned with the release groove.

In another preferred form of the present invention, the release groove is oriented at 30° to 60° from one of the tumbler grooves. In a preferred form in which there are four equally spaced tumbler grooves, the release groove is oriented at substantially 45° from one of the tumbler grooves.

In yet another aspect of the present invention, a removable plug lock includes a generally cylindrical plug having an axially extending key slot extending from a key face at one end of the plug. The plug further includes a plurality of tumblers engageable with a key for movement between a first position retracted within the cylindrical plug and a second position with one end extending from the plug. A retaining one of the tumblers is spaced from the plug one end a selected distance. A retaining tab extends from the plug at a position spaced substantially the selected distance from the plug one end. A shell has a central opening for receiving the plug with the plug key face substantially at one end of the shell, and further includes an annular shoulder facing away from the shell one end and spaced substantially the selected distance from the shell one end, tumbler grooves along the sides of the central opening and adapted to receive aligned tumblers in the second position, the tumbler grooves extending from the shell one end less than the selected distance, and a release groove extending a side of the central opening and angularly spaced from the tumbler grooves, the release groove extending the selected distance from the first shell end to define an opening in the shoulder. Engagement of either the retaining tab or the retaining tumbler with the annular shoulder retains the plug against removal from the shell one end.

It is an object of the invention to provide a secure lock which may provide a full range of motion, with multiple different locked positions, while also allowing the key plug to be easily removed for replacement or repair as may be needed over the useful life of the lock.

BRIEF DESCRIPTION OF THE DRAWINGS

FIG. 1 is an exploded view of the present invention, showing the shell and plug with a key;

FIG. 2 is a cross-sectional view showing the lock plug in its removing position in the shell;

FIG. 3 is a cross-sectional view showing the lock plug with the operating key;

FIG. 4 is a cross-sectional view showing the lock plug with its removing key;

FIG. 5 is a cross-sectional view showing the lock plug in its locking configuration without any key; and FIG. 6 is an exploded view illustrating the cooperation of the plug retaining tab and the release groove and retaining shoulder (for simplicity and to reduce clutter in this figure, the plug tumblers and shell tumbler grooves have been omitted).

DESCRIPTION OF THE PREFERRED EMBODIMENT

The removable plug lock 10 of the present invention is shown in exploded view in FIG. 1. A plug 12 is insertable to a barrel-shaped shell 14 and is rotatable within the barrel-shaped shell 14 by means of an operating key 16. As explained in greater detail below, a different removing key 16*a* (see FIG. 4) is used to permit the plug 12 to be removed from the shell 14.

The shell 14 is suitably mounted to the device to be locked. Though not illustrated in the figures, a wide variety of such types of mounting are well known in the art and may be readily used within the scope of the present invention. For example, the shell may be provided with a flange at its key end and the outer surface of the shell may be threaded to support a bolt whereby the surface of the device to be locked may be readily secured between the shell flange and the bolt. Further, though not shown, the shell may also be provided with one or more flat portions for mating with a similarly shaped opening in the device to be locked, with cooperation between the two securing the shell against pivoting relative to the device. Of course, it will be readily apparent once a full understanding of the present invention is obtained that virtually any manner of securing the shell to the device will be usable depending principally on the device.

The plug 12 has a cylindrical body with two ends. A collared key entry end or key face 18 has a generally axially extending key slot 19 for receiving either of the keys 16, 16*a* in the plug 12. The other plug end is the actuating end 20 and may have thereon whatever is required in the given application (such as lugs, tabs, or electrical terminals; a lug 21 is shown in FIG. 1) for connection to the particular mechanism to be controlled by the lock 10. A plug retaining tab 22 (as described further below) projects axially from the body of the plug 12 near the actuating end 20.

Several tumbler slots 24 are provided within the plug 12, as is generally known in the art. Tumblers 28 are disposed in these slots 24. In the disclosed preferred embodiment, the tumblers 28 have a height which is no greater than the outer diameter of the plug 12 so that the tumblers 28 may be completely disposed within the plug 12 by a key 16, without either end projecting therefrom. The tumblers 28 also each have a key slot 30 enabling a key inserted into the plug key slot 19 to slide through the tumbler key slots 30, to position the tumblers 28 relative to the plug 12 as is well known in the art.

The tumblers 28 shown in the preferred embodiment are of a well known type, with an arm 32 on one side engaged by a compression spring 34 disposed in a plug hole alongside the tumbler slot 24 (see FIG. 2), whereby the spring 34 biases the tumbler 28 toward extending from one end of the plug tumbler slot 24. As is well known in the art, the tumbler key slots 30 are variously positioned on the tumblers 28 so that only a selected key 16 inserted therein will retract all of the tumblers 28 into the plug 12 to enable the plug 12 to be turned in the shell 14 as is described in greater detail hereafter.

It should be understood that still other forms of key and tumbler combinations can be used within the scope of this invention. For example, though the tumblers shown use a key 16 having bits on one side. A two sided key could also be used. As another example, although the tumblers 28 are shown all biased toward one side of the plug 12, they could also be alternately biased, with some biased in one direction and others biased in the other direction.

As yet another example, though the Figures illustrate a plug 12 having a total of five tumblers 28, more or less tumblers could also be used within the scope of the invention. Further, the tumblers 28 could be evenly spaced along the plug 12, or could be axially spaced variable distances along the plug 12 as discussed in further detail hereafter.

Still further, a detent tumbler could be provided with a tapered end, with the key 16 bitted so as to not control that detent tumbler, whereby the detent tumbler is always biased toward extending from the plug 12. The detent tumbler would not serve to hold the plug in a locked position as turning the plug 12 would cause the detent tumbler to be pushed down into its slot 24 (through engagement of the tumbler tapered end with the shell, typically with a matching tapered portion of the shell groove). As the plug 12 reaches one of its locked positions during turning, the detent tumbler would automatically click up into the groove to provide a positive feel indicating that the plug 12 is in a position with the tumblers aligned with the shell grooves (for removal of the key). With the preferred structure in which the plug removal position is not one of the plug locked positions in which the key may be removed, the detent tumbler could also be used in combination with a special detent groove in the shell to provide a positive feel indicating when the plug is in its removal position. It should be understood that though such a detent tumbler could be used within the scope of this invention, such a detent tumbler would not be a tumbler 28 of the type otherwise referred to herein (and in the claims hereof) which properly must be manipulated by a key 16 in order to retract it into the plug 12.

In short, it should be recognized that the basic configuration of the plug and tumblers could be any of a variety of embodiments.

The plug retaining tab 22 noted above is circumferentially offset from the tumblers 28. For example, in the preferred embodiment shown in the drawings (and as best shown in FIG. 2), the tumblers 28 project radially from the plug 12 at about an angle to a radial line bisecting the plug retaining tab 22.

In the illustrated preferred embodiment, the tumbler 28' at the rear end of the plug 12 (that is, the end opposite the key face 18) is on its forwardly facing side substantially axially aligned with the forwardly facing side of the retaining tab 22. This rear tumbler is a retaining tumbler 28'.

In the embodiment illustrated in the Figures, all of the tumblers 28, including the retaining tumbler 28', are axially spaced evenly along the plug 12. However, it should be understood that in many embodiments it may be preferred to have uneven tumbler spacing, as previously mentioned. For example, the retaining tumbler 28' in particular may be advantageously spaced further from the adjacent tumbler 28 than the other tumblers 28 are spaced from each other. In such a case, the retaining tumbler 28' would be further spaced from the key face 18 so as to be harder to reach should someone attempt to improperly manipulate the lock 10 to remove the plug 12. Further, such a configuration could be provided so that the removing key 16*a* would be noticeably longer than the operating key 16, to assist in recognition of the appropriate key. Still further, uneven spacing of the retaining tumbler 28' from the other tumblers 28 could be used to complicate the fraudulent making of a removing key 16*a* from an operating key 16, as not only would the proper bitting for the retaining tumbler 28' be unknown, but so would its axial position along the key 16*a*. Security might also be enhanced by limiting the availability of the longer key blanks which might be used in making the removing key 16*a*.

The shell 14 has a generally cylindrical opening 36 for receiving the plug 12. In the preferred embodiment shown in the Figures, cooperating tumbler grooves 38, 40 are also provided on opposite sides of the opening 36 (see FIGS. 1 and 2). (Opposite sets of tumbler grooves are usually preferred to allow the tumblers 28 to move both up and down as the various bits of the key 16 pass the tumblers 28 as the key 16 is inserted or removed.)

A circumferential groove is disposed at the rear end of the shell 14 and defines a rearwardly facing retaining surface 42 (seen in phantom in FIGS. 2 and 5). The groove in the preferred embodiment extends 360° around the shell 14, to allow the plug 12 to be freely turned 360° as will be recognized once a full understanding of the invention is obtained. However, it would still be within the scope of the invention for the groove to be less than 360° if less freedom of motion for the plug 12 is desired in any given application.

The retaining surface 42 is substantially axially aligned with the forwardly facing sides of the retaining tab 22 and retaining tumbler 28'. In this preferred embodiment as described in greater detail below, the retaining tab 22 and the retaining tumbler 28' are axially aligned so that both cooperate with the same retaining surface 42. Once an understanding of the present invention is obtained, however, it will be recognized that the tab 22 and retaining tumbler 28' could alternatively be axially spaced from one another and cooperate with different axially spaced circumferential retaining surfaces and still fall within the scope of the present invention.

In the illustrated preferred embodiment, there are four tumbler grooves, two cooperating grooves with each set of grooves 38, 40, with the four grooves each spaced 90° apart. This thus allows the plug 12 in this embodiment to be turned between four different positions. Different numbers of tumbler grooves, or differently oriented tumbler grooves, could also be used within the scope of this invention, however. The tumbler grooves 38, 40 do not extend fully rearwardly to the circumferential groove, so that they do not extend through the retaining surface 42. Instead, the tumbler grooves 38, 40 extend axially only far enough to accept the rearwardmost tumbler 28 in front of the retaining tumbler 28' when the plug 12 is positioned in the shell 14.

A release groove 46 is also provided on the outside of the shell opening 36 (see FIGS. 1, 2 and 6). The release groove 46 does extend fully rearwardly to the circumferential groove, so that it extends through the retaining surface 42 to define a release opening 48 therein (see FIG. 6).

The release groove 46 is circumferentially offset from the tumbler grooves 38, 40. For example, in one preferred embodiment, the release groove 46 could be oriented at a different angle relative to the tumbler grooves 38, 40 than are the tumblers 28 relative to the retaining tab 22. With such a configuration, as will become apparent hereafter, in each of the locked positions, the plug 12 will be retained in the shell 14 by both the retaining tab 22 and the retaining tumbler 28' so that manipulation of the retaining tumbler 28' will not permit removal of the plug 12 from the shell 14.

Alternatively, the tumblers 28 can project radially from the plug 12 at substantially the same angle from the plug retaining tab 22 as the release groove 46 is from one of the tumbler grooves 38, 40 (for example, 45°). With such an embodiment, with the angular spacing the same 45°, both the retaining tab 22 and the retaining tumbler 28' will be behind the retaining surface 42 in three of the four positions, and at least one of the retaining tab 22 and retaining tumbler 28' will be behind the surface 42 in the fourth position. This is not, however, a preferred embodiment as discussed below.

Still further, once a full understanding of the present invention is had, it will be recognized that one of the tumbler grooves could be extended through the retaining surface to also function as a release groove, without the necessity for a separate release groove 46.

The operation of the lock 10 is as follows.

When the lock 10 is in one of its four positions with the key 16 removed from the plug 12, the tumblers 28 project from the plug 12 (such as illustrated in FIG. 5) and into one of the tumbler grooves 38, 40 to thereby prevent rotation of the plug 12 in the shell 14. In this position, the retaining tumbler 28' also projects from the plug 12, so that both the retaining tumbler 28' and the retaining tab 22 are in the circumferential groove. In a preferred embodiment, in which the retaining tab 22 has a different angular spacing from the tumblers 28 than does the release groove 46 from the tumbler grooves 38, 40, both the retaining tab 22 and the retaining tumbler 28' will be behind the retaining surface 42 to retain the plug 12 in the shell 14 in every locked position.

As previously noted, if the tab 22/tumbler 28 spacing were equal to the groove 46/groove 38, 40 spacing, then in one of the locked positions, only the retaining tumbler 28' will secure the plug 12 in the shell 14. Though this embodiment is within the scope of the invention, it is not as preferred as the others described herein, since it would allow the plug to be removed by merely manipulating the retaining tumbler 28'. In the further embodiment in which one of the tumbler grooves 38, 40 also functions as the release groove, then in one of the locked positions, only the retaining tab 22 will secure the plug 12 in the shell 14.

During normal operation of the lock 10, using an operating key 16 which does not retract the retaining tumbler 28' (see FIG. 3), the other tumblers 28 are retracted clear of the tumbler grooves 38, 40 to permit free turning of the plug 12 in the shell 14. During such turning, at one position the retaining tab 22 will be aligned with the release groove 46 but the lock 10 will nevertheless be retained therein by the cooperation of the retaining tumbler 28' with the retaining surface 42. At a second position during operational turning, the retaining tumbler 28' will be aligned with the release groove 46 but the lock 10 will nevertheless be retained therein by the cooperation of the retaining tab 22 with the retaining surface 42. Neither of these positions will be readily apparent to a position attempting to defeat the lock 10, and in any event both are secure against plug removal. In all other positions, the plug 12 is retained in the shell 14 by the cooperation of both the retaining tab 22 and the retaining tumbler 28' with the retaining surface 42.

In some instances, it is necessary to be able to remove the lock plug 12, whether for maintenance or to facilitate easy changing of the plug and tumbler combination used therewith for security (when a key is lost or otherwise falls into unauthorized hands, for example). This can be easily accomplished by use of the special removing key **16*a* illustrated in FIG. 4**.

Specifically, the special removing key **16*a* has a different end bit than the operating key 16 (see FIG. 3) so that it will retract all of the tumblers 28, including the retaining tumbler 28'. Since the retaining tumbler 28' when retracted into the plug 12 will not cooperate with the retaining surface 42 to prevent plug removal, the plug 12 with the key 16*a* need merely be turned to the position in which the retaining tab 22 is aligned with the release groove 46, in which position the plug 12 may be pulled out with the tab 22 passing through the release opening 48 and along the length of the groove 46**.

Still other aspects, objects, and advantages of the present invention can be obtained from a study of the specification, the drawings, and the appended claims.

We claim:

1. A lock with removable keyed plug comprising:

a removable plug having a substantially cylindrical body with an axially oriented key opening and radially oriented tumbler slots therein;

a plurality of tumblers disposed within said body tumbler slots, each of said tumblers having a key engaging opening and being movable in said tumbler slots between a first position retracted within the cylindrical body of the plug and a second position with one end extending from said body, wherein at least one of said tumblers is a retaining tumbler;

a retaining tab extending radially from said plug body at a first selected angle from the radial orientation of the tumbler slots; and a shell having a substantially cylindrical opening therein for removably receiving said plug in a first shell end, said shell further including at least one annular shoulder spaced from said first shell end and engageable by said plug retaining tab, and by said retaining tumbler when in the second position, at least one tumbler groove extending axially along a side of said shell opening from said first shell end to a groove end short of said at least one shoulder, and a release groove extending axially along said shell opening from said first shell end to said at least one shoulder to define an opening in said at least one shoulder, said release groove being at a second selected angle from the tumbler groove, wherein the second selected angle is substantially different than the first selected angle;

whereby engagement of either said retaining tab or said retaining tumbler with said at least one annular shoulder retains said plug in said shell.

2. The lock of claim 1, wherein:

said retaining tumbler and said retaining tab are substantially axially oriented along said plug body; and said at least one annular shoulder is a single annular shoulder engageable by both said plug retaining tab and said retaining tumbler when in the second position.

3. The lock of claim 1, wherein said retaining tab and said retaining tumbler in the second position both cooperate with said at least one annular shoulder to retain said plug in said shell in all but two angular positions of said plug in said shell.

4. The lock of claim 1, further comprising a second tumbler groove extending axially along said shell opening and spaced from said release groove.

5. The lock of claim 4, wherein said second tumbler groove extends from said first shell end to a groove end short of said at least one annular shoulder engageable by said plug retaining tab.

6. The lock of claim 4, further comprising third and fourth tumbler grooves extending axially along said shell opening, wherein said first, second, third and fourth tumbler grooves are substantially equally spaced at 90° about said shell opening.

7. The lock of claim 1, further comprising a key set including an operating key and a removing key, wherein said operating key engages said tumbler key slots to orient all but the retaining tumbler in said first position, and said removing key engages said tumbler key slots to orient all of the tumblers in said first position.

8. The lock of claim 7, wherein said operating key retracts all but the retaining tumbler within the plug cylindrical body to permit pivoting of the plug within the shell with at least one of the retaining tab and the retaining tumbler engageable with the at least one annular shoulder to retain said plug in said shell.

9. The lock of claim 8, wherein said retaining tab and said retaining tumbler in the second position both retain said plug in said shell in all but two angular positions of said plug in said shell.

10. The lock of claim 8, wherein said removing key retracts all of the tumblers within the plug cylindrical body to permit pivoting of the plug within the shell to a removal position in which the retaining tab is aligned with the release groove.

11. The lock of claim 1, wherein said release groove is oriented at 30° to 60° from said at least one tumbler groove.

12. The lock of claim 11, wherein said release groove is oriented at substantially 45° from said at least one tumbler groove.

13. The lock of claim 1, wherein said at least one tumbler groove comprises a first set of radially opposed tumbler grooves in said shell, and further comprising a second set of radially opposed tumbler grooves in said shell, said second set being oriented at substantially 90° from said first set of tumbler grooves whereby the lock allows removal of a key from any of four angular positions.

14. The lock of claim 13, wherein said release groove is oriented at substantially 45° from one of said tumbler grooves.

15. The lock of claim 1, further comprising means for biasing said tumblers from said first position to said second position.

16. A removable plug lock comprising:

a substantially cylindrical plug having an axially extending key slot extending from a key face at a first end of said plug, said plug further including a plurality of tumblers therein radially movable by engagement with a key between a first position retracted within the cylindrical plug and a second position with one end extending from said plug, wherein one of said tumblers is spaced from said first end a first selected distance and is a retaining tumbler, and a retaining tab extending from said plug and spaced a second selected distance from said first end, said retaining tab having a first angular spacing from said tumblers; and a shell having a central opening for receiving said plug with said plug key face substantially at one end of said shell, said shell further including at least one annular shoulder facing away from said shell one end and spaced substantially at least one of said first and second selected distances from said shell one end, tumbler grooves along the sides of said central opening and adapted to receive aligned tumblers in said second position, said tumbler grooves extending from said shell one end less than said second selected distance, and a release groove extending along a side of said central opening and angularly spaced from said tumbler grooves, said release groove extending said at least one of said first and second selected distances from said shell one end to define an opening in said at least one annular shoulder, said release groove having a second angular spacing from the tumbler grooves whereby when said retaining tab is aligned with said release groove said tumblers are not aligned with the tumbler grooves;

whereby engagement of either said retaining tab or said retaining tumbler with said at least one annular shoulder retains said plug against removal from the shell one end.

17. The lock of claim 16, wherein said first selected distance and said second selected distance are the same so that said retaining tumbler and said retaining tab are substantially axially oriented along said plug body, and said at least one annular shoulder is a single annular shoulder engageable by both said plug retaining tab and said retaining tumbler when in the second position.

18. The lock of claim 16, wherein said retaining tab and said retaining tumbler in the second position both cooperate with said at least one annular shoulder to retain said plug in said shell in all but two angular positions of said plug in said shell.

19. The lock of claim 16, further comprising a key set including an operating key and a removing key, wherein said operating key engages said tumblers to orient all but the retaining tumbler in said first position, and said removing key engages said tumblers to orient all of the tumblers in said first position.

20. The lock of claim 19, wherein said operating key retracts all but the retaining tumbler within the plug to permit pivoting of the plug within the shell with at least one of the retaining tab and the retaining tumbler aligned with said at least one annular shoulder to retain said plug in said shell.

21. The lock of claim 20, wherein said removing key retracts all of the tumblers within the plug to permit pivoting of the plug within the shell to a removal position in which the retaining tab is aligned with the release groove.

22. The lock of claim 16, wherein said release groove is oriented at 30° to 60° from one of said tumbler grooves.

23. The lock of claim 22, wherein said release groove is oriented at substantially 45° from one of said tumbler grooves.

24. The lock of claim 16, wherein there are four tumbler grooves angularly spaced substantially 90° from one another, whereby the lock allows removal of a key from any of four angular positions.

25. The lock of claim 24, wherein said release groove is oriented at substantially 45° from one of said tumbler grooves and said plug is removable from said shell by a removing key when said plug is in a fifth angular position different from said four angular positions.

26. The lock of claim 16, further comprising means for biasing said tumblers from said first position to said second position.

* * * * *